US006499601B1

(12) United States Patent
Foster et al.

(10) Patent No.: US 6,499,601 B1
(45) Date of Patent: Dec. 31, 2002

(54) SYSTEM FOR SUSPENDING A PLURALITY OF PRODUCT PACKAGES FROM A PEG IN A SINGLE OPERATION

(75) Inventors: Brian W. Foster, Trumbull, CT (US); Anthony Marciano, Orange, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 20 days.

(21) Appl. No.: 09/730,063

(22) Filed: Dec. 5, 2000

(51) Int. Cl.[7] ..... B65D 85/00
(52) U.S. Cl. ..... 206/526; 206/497; 206/806
(58) Field of Search ..... 206/223, 228, 206/352, 354, 471, 499, 497, 525, 526, 806

(56) References Cited

U.S. PATENT DOCUMENTS 3,148,770 A * 9/1964 Cosman ..... 206/526
3,721,339 A * 3/1973 Seyer ..... 206/499
3,970,194 A * 7/1976 Iten ..... 206/228
4,072,232 A * 2/1978 Marsman et al. ..... 206/526
4,111,297 A * 9/1978 Paulin ..... 206/526
4,177,895 A * 12/1979 Shelton ..... 206/497
4,219,140 A * 8/1980 Simonoff ..... 206/806
4,895,255 A * 1/1990 Fisher ..... 206/497

* cited by examiner

*Primary Examiner*—Luan K. Bui
(74) *Attorney, Agent, or Firm*—McCormick, Paulding & Huber LLP

(57) ABSTRACT

In a system for suspending, in a single operation, a plurality of product packages on a peg, each product package includes an upwardly extending mounting portion defining a shaped slot adapted to slidably receive the peg. The slot defines a peripheral edge for engaging the peg and suspending the product package therefrom. The system also includes a band of polymeric material that engages and at least partially surrounds the plurality of product packages, binding them together such that each shaped slot is approximately aligned with the next successive slot to allow said peg to be slidably threaded through each of the mounting portions. The band of polymeric material also includes a release portion, along which the band may be torn, thereby separating the band from the product packages to provide access to individual packages suspended from the peg.

15 Claims, 2 Drawing Sheets

SYSTEM FOR SUSPENDING A PLURALITY OF PRODUCT PACKAGES FROM A PEG IN A SINGLE OPERATION

FIELD OF THE INVENTION

The present invention generally relates to product packaging, and is more specifically directed to binding a plurality of such packages together in such a manner as to enable said packages to be easily suspended from a peg in a single operation.

BACKGROUND OF THE INVENTION

The present invention has particular utility with respect to the packaging of disposable razors for retail sale and the inefficiencies currently encountered with producing displays of such packages in retail outlets, and is described herein as applied to such use. However, the present invention also has utility with regard to the packaging of other items, such as disposable cigarette lighters, candy, and consumer items typically suspended from retail pegs. Therefore, as used herein, the term "package", or the phrase "product package" should be broadly construed to mean packaging for retaining consumer items, such packaging being displayable by hanging from a retail peg.

Generally, consumer items such as disposable razors are packaged in limited numbers with the packaging being mounted from a rod projecting outwardly from a wall. Usually, these rods are in the form of elongated cylindrical members adapted to be mounted at one end to a peg-board and hooked at the opposite end to prevent product packages suspended therefrom from sliding off. These elongated cylindrical members are referred to by those skilled in the pertinent art to which the present invention pertains as "retail pegs."

Typically, product packages are received from a manufacturer in shipping containers with several individual product packages contained loosely therein. These product packages must then be removed from the shipping container by a retail outlet employee, and mounted to the retail pegs one at a time, usually via a circular hole extending through the package. A problem associated with product packages configured in the above-described manner is that mounting the packages one at a time to the retail peg is very time consuming and therefore expensive.

Another problem occurs when a retail store employee attempts to load more than one product package onto a retail peg. Often these packages are of a size making it unwieldy for the employee to hold more than one or two packages at a time. Furthermore, the packages usually contain a single circular-mounting hole that is difficult to align between successive product packages when attempting to load more than one package at a time onto the retail peg.

Based on the foregoing, it is the general object of the present invention to provide a system for suspending, in a single operation, a plurality of product packages on a retail peg that overcomes the drawbacks and problems associated with prior art systems.

It is a more specific object of the present invention to provide a system whereby a plurality of product packages can be loaded onto a retail peg in a single operation, yet consumers can still access individual packages.

SUMMARY OF THE INVENTION

One aspect of the present invention is directed to a system for suspending, in a single operation, a plurality of product packages on a peg wherein each product package includes an upwardly extending mounting portion defining a shaped slot adapted to slidably receive the peg. Each shaped slot includes a peripheral edge that engages the peg supporting the suspended product package thereon. A band of polymeric material engages and at least partially surrounds the plurality of product packages, thereby binding the packages together as a single unit. In addition, the shaped slot of each product package is approximately aligned with the shaped slot of the next successive package to allow the peg to be slidably threaded through each of the mounting portions. The band of polymeric material also includes releasing means for separating the band from the product packages to provide consumers and others with access to individual packages suspended from the peg.

Preferably, the releasing means includes a plurality of closely spaced perforations extending along a path projected across the width of the band of polymeric material. The perforations allow the band of polymeric material to be easily torn along the path across which the perforations extend to separate the band from the product packages. Once the band of polymeric material is removed, consumers and others are provided with access to the individual product packages.

In the preferred embodiment of the present invention, the slot extending through the mounting portion of the product packages is "J" shaped. In addition, the material from which band of polymeric material is constructed is of the type commonly referred to as "shrink wrap" material which, when exposed to sufficient heat, undergoes a dimensional change. However, the present invention is not limited in this regard as other types of polymeric material, such as resilient materials, can be employed without departing from the broader aspects of the present invention.

An advantage of the present invention is that multiple product packages can be loaded onto a peg in a single operation.

Another advantage of the present invention is that the shaped slots allow for misalignment between the product packages once they are bound together by the band of polymeric material, yet the peg can still be easily threaded through each product package.

DETAILED DESCRIPTION OF THE PREFERRED EMBODIMENT

Figure 1:
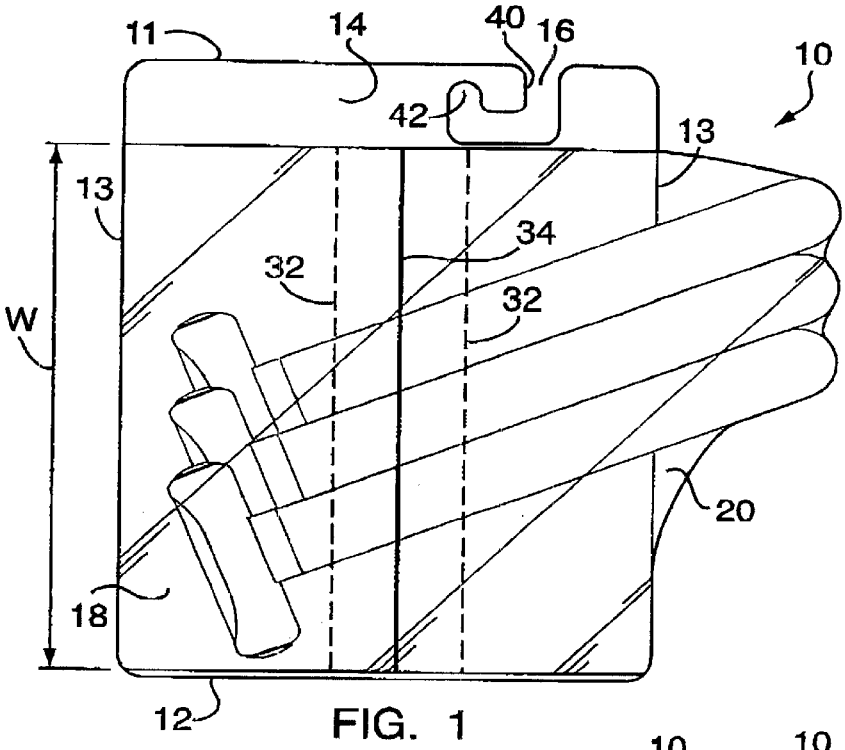
FIG. 1 is a front elevational view of a plurality of product packages bound together by a band of polymeric material wrapped around the packages.
Figure 2:
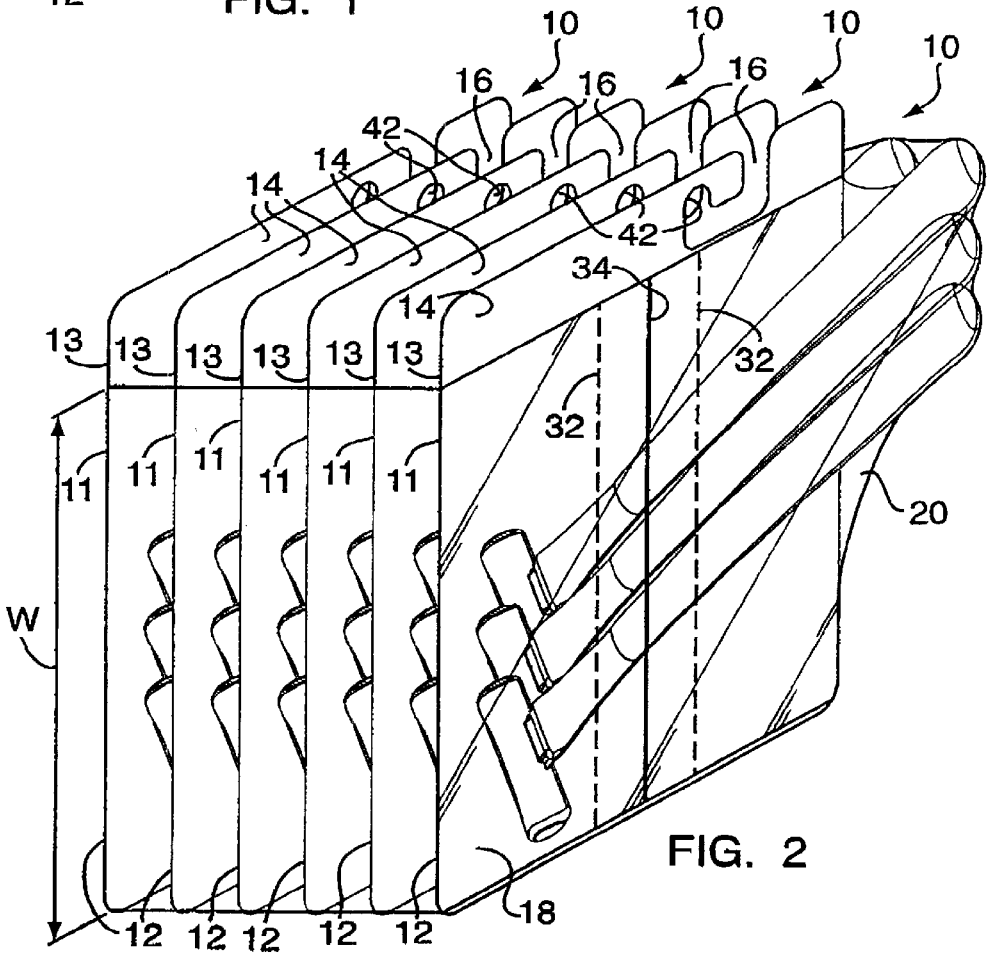
FIG. 2 is a perspective view of the plurality of product packages of FIG. 1.

As shown in FIGS. 1 and 2, a plurality of product packages, six shown, are each generally designated by the reference number 10. In the illustrated embodiment, each product package 10 consists of what is commonly referred to as a "blister pack" having a rear panel 12 that includes a rear surface 11, opposed, spaced-apart lateral edges 13, and an upwardly extending mounting portion 14 defining a shaped slot 16, shown in the illustrated embodiment as being J-shaped, extending therethrough. A blister 18 is attached to, and extends outwardly from, a front surface of the rear panel 12 and is adapted to retain products, disposable razors in the illustrated embodiment, therein. It is preferable that the blister 18 be formed from a transparent polymeric material such as polyvinylchloride (hereinafter PVC). However, the present invention is not limited in this regard as other suitable materials having translucent or opaque characteristics can be substituted. In addition, while disposable razors have been described and shown in the illustrated embodiment, the present invention is not limited in this regard as any product which can practically be placed in a blister pack can be substituted without departing from the broader aspects of the present invention. Moreover, while blister packs have been shown and described, the present invention is not limited in this regard as any product package amenable to being suspended from a retail peg, as will be explained in detail hereinbelow, can be substituted.

Still referring to FIGS. 1 and 2, a band of polymeric material 20 engages and at least partially surrounds the plurality of product packages 10, binding the plurality of product packages together such that each shaped slot 16 is approximately aligned with the next successive slot. In the illustrated embodiment, the band of polymeric material 20 extends about the spaced apart lateral edges 13 of the plurality of product packages 10, around the rear surface 11 of the last of said product packages and across the blister of the first of the plurality of product packages. Preferably, the band of polymeric material 20 is PVC and is of the type commonly referred to as "shrink wrap" material which when exposed to sufficient heat undergoes a dimensional change and shrinks relative to the item around which it is wrapped. However, the present invention is not limited in this regard as other types of material, such as a resilient material, can be used to bind the plurality of product packages together.

The band of polymeric material 20 defines a plurality of closely spaced perforations 32 extending along a path projected across a width "w" defined by the band. In the illustrated embodiment, the perforations 32 extend along two approximately parallel spaced apart lines. As will be explained in greater detail below, during operation, the band of polymeric material 20 can be torn along the perforations 32 to separate the band of polymeric material from the plurality of product packages 10. In the illustrated embodiment, a locator stripe 34, which may be of any color, is positioned between the rows of perforations, extending the width of the band of polymeric material 20. In use, the locator stripe 34 provides a readily identifiable indication of where the band of polymeric material 20 must be torn. While two rows of perforations 32 have been shown and described, the present invention is not limited in this regard as a single row of perforations, or multiple rows of perforations, can be employed without departing from the broader aspects of the present invention. Furthermore, while perforations 32 have been shown and described, the present invention is not limited in this respect as other tear facilitating means, such as scoring the band of polymeric material, can be substituted without departing from the broader aspects of the present invention.

Figure 3:
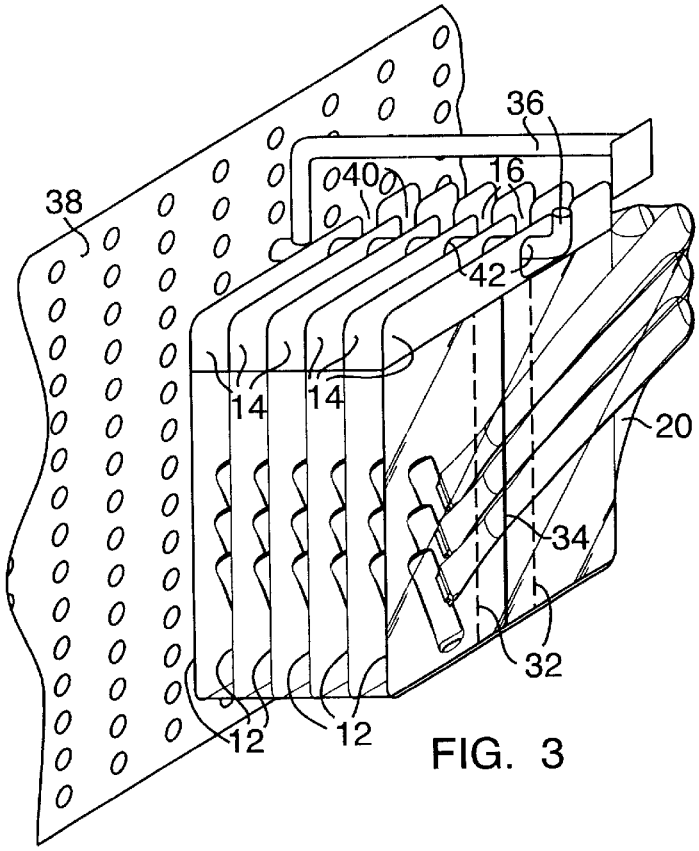
FIG. 3 illustrates the plurality of product packages still bound together as shown in FIGS. 1 and 2, and suspended from a retail peg.

The manner in which the present invention is used will now be explained; accordingly, reference should be had to FIGS. 3 and 4. The product packages bound together in the above-described manner and referred to hereinafter as "bundles" are generally received from the manufacturer in shipping containers (not shown) with each container carrying one or more product package bundles therein. Each bundle is removed, usually by a retail outlet employee, from the shipping container and is suspended on a retail peg 36, which in turn extends outwardly from a pegboard 38. The J-shaped slots 16 extending through the mounting portions 14 of each product package 10 allow the bundles to be loaded onto the retail peg 36. This is accomplished by simply aligning an inlet portion 40, best seen in FIG. 1, defined by each slot 16, with the retail peg 36 and pushing the bundle up and over until the retail peg is positioned in the hooked portion 42 of the J-shaped slot. A further advantage of utilizing the J-shaped slots 16 is that the slots can be slightly misaligned between successive product packages 10 and still be mountable onto the retail peg 36. While retail pegs have been shown and described, the present invention is not limited in this regard as the product packages can be hung from any type of protrusion or peg which the slots in the packages can accommodate.

Figure 4:
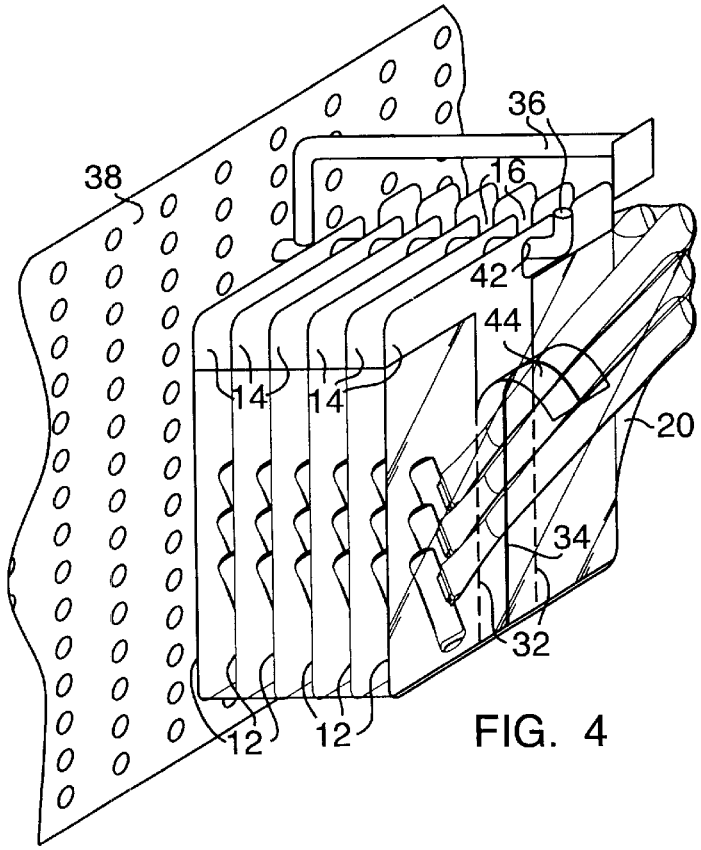
FIG. 4 illustrates the plurality of product packages as shown in FIG. 3 with a portion of the band of polymeric material torn away along a pair of approximately parallel lines of closely spaced perforations.

Turning to FIG. 4, once a product package bundle is positioned onto the retail peg 36, the band of polymeric material 20 can be torn along the lines formed by the perforations 32, thereby causing an areal portion or strip 44 of the band of polymeric material to be removed therefrom. Once the strip 44 is removed, the band of polymeric material 20 can also be removed from the product packages 10, thereby providing access to individual packages.

While preferred embodiments have been shown and described, various modifications and substitutions may be made without departing from the spirit and scope of the invention. Accordingly, it is to be understood that the present invention has been described by way of example, and not by limitation.

What is claimed is:

1. A system for suspending, in a single operation, a plurality of product packages on a peg, said system comprising:

a plurality of product packages, each having an upwardly extending mounting portion defining a shaped slot having an inlet adapted to slidably receive said peg, said shaped slot defining a peripheral edge for engaging said peg and suspending said product package therefrom;

a band of polymeric material engaging and at least partially surrounding said plurality of product packages, so that each of said inlets is approximately aligned with the next successive inlet to allow said peg to be simultaneously received in each inlet thereby binding said plurality of product packages together; and wherein said band of polymeric material includes releasing means for separating said band from said product packages to provide access to individual packages suspended from said peg.

2. A system for suspending, in a single operation, a plurality of product packages on a peg, as defined by claim 1, wherein:

said releasing means includes a plurality of closely spaced perforations extending along at least one path projected across a width defined by said band of polymeric material to allow said band to be easily torn along said path separating said band from said product packages.

3. A system for suspending, in a single operation, a plurality of product packages on a peg, as defined by claim 2, wherein said plurality of perforations are positioned so as to extend along two spaced apart lines, each spanning the width of said band so that tearing said band along said lines causes an areal portion of said band extending between said lines to be removed, thereby separating said band of polymeric material from said product packages.

4. A system for suspending, in a single operation, a plurality of product packages on a peg, as defined by claim 1 wherein said band of polymeric material is a shrink-wrap-type material.

5. A system for suspending, in a single operation, a plurality of product packages on a peg, as defined by claim 1 wherein said band of polymeric material is formed from polyvinylchloride.

6. A system for suspending, in a single operation, a plurality of product packages on a peg, as defined by claim 1, wherein said shaped slot is "J" shaped.

7. A system for suspending, in a single operation, a plurality of product packages on a peg, as defined by claim 1, wherein:

said product package is a blister pack, including a panel defining said mounting portion, and a blister extending outwardly from said panel and adapted to retain a product therein.

8. A system for suspending, in a single operation, a plurality of product packages on a peg, as defined by claim 7, wherein said blister is formed from polyvinylchloride.

9. A system for suspending, in a single operation, a plurality of product packages on a peg, as defined by claim 7, wherein said blister and said panel cooperate to retain a plurality of razors therebetween.

10. A system for suspending, in a single operation, a plurality of product packages on a peg, as defined by claim 9, wherein:

said rear panel includes a pair of spaced apart lateral edges, a front surface from which said blister extends, and a rear surface;

said band of polymeric material extends about said spaced apart lateral edges of said plurality of product packages, around said rear surface of the last of said product packages and across said blister of the first of said plurality of product packages;

said releasing means includes a plurality of perforations extending along a path across a width defined by said band of polymeric material to allow said band to be easily torn along said path separating said band from said product packages; and wherein said perforations are located on a portion of said band coincident with said blister of the first of said plurality of product packages.

11. A system for suspending, in a single operation, a plurality of product packages on a peg, as defined by claim 9, wherein said plurality of product packages includes six packages.

12. A system for suspending, in a single operation, a plurality of product packages on a peg, said system comprising:

a plurality of product packages, each having an upwardly extending mounting portion defining a shaped slot adapted to slidably receive said peg, said shaped slot defining a peripheral edge for engaging said peg and suspending said product package therefrom;

a band of polymeric material engaging and at least partially surrounding said plurality of product packages, thereby binding said plurality of product packages together such that each of said shaped slots is approximately aligned with the next successive slot to allow said peg to be slidably threaded through each of said mounting portions;

said band of polymeric material including releasing means for separating said band from said product packages to provide access to individual packages suspended from said peg;

said releasing means including a plurality of closely spaced perforations extending along at least one path projected across a width defined by said band of polymeric material to allow said band to be easily torn along said path separating said band from said product packages;

said plurality of perforations being positioned so as to extend along two spaced apart lines, each spanning the width of said band so that tearing said band along said lines causes an areal portion of said band extending between said lines to be removed, thereby separating said band of polymeric material from said product packages; and wherein said releasing means includes a locator stripe positioned between said spaced apart lines to provide a readily identifiable indicator of where said band of polymeric material should be torn.

13. A system for suspending, in a single operation, a plurality of product packages on a peg, said system comprising:

a plurality of product packages, each having an upwardly extending mounting portion defining a J-shaped slot having an inlet adapted to slidably receive said peg, said J-shaped slot defining a hook portion for engaging said peg and suspending said product package therefrom;

a band of polymeric material engaging and at least partially surrounding said plurality of product packages, thereby binding said plurality of product packages together so that each of said inlets is approximately aligned with the next successive inlet to allow said peg to be simultaneously received in each inlet; and wherein said band of polymeric material includes a plurality of closely spaced perforations extending along at least one path projected across a width defined by said band of polymeric material to allow said band to be easily torn along said path separating said band from said product packages.

14. A system for suspending, in a single operation, a plurality of product packages on a peg, as defined by claim 13, wherein said plurality of perforations are positioned so as to extend along two spaced apart lines, each spanning the width of said band so that tearing said band along said lines causes an areal portion of said band extending between said lines to be removed thereby separating said band of polymeric material from said product packages.

15. A system for suspending, in a single operation, a plurality of product packages on a peg, said system comprising:

a plurality of product packages, each having an upwardly extending mounting portion defining a J-shaped slot adapted to slidably receive said peg, said J-shaped slot defining a hook portion for engaging said peg and suspending said product package therefrom;

a band of polymeric material engaging and at least partially surrounding said plurality of product packages, thereby binding said plurality of product packages together such that each of said J-shaped slots is approximately aligned with the next successive slot to allow said peg to be slidably threaded through each of said mounting portions; and wherein said band of polymeric material including a plurality of closely spaced perforations extending along at least one path projected across a width defined by said band of polymeric material to allow said band to be easily torn along said path separating said band from said product packages;

said plurality of perforations being positioned so as to extend along two spaced apart lines, each spanning the width of said band so that tearing said band along said lines causes an areal portion of said band extending between said lines to be removed thereby separating said band of polymeric material from said product packages; and wherein said releasing means includes a locator stripe positioned between said spaced apart lines to provide a readily identifiable indicator of where said band of polymeric material should be torn.

* * * * *